US010550644B2

(12) United States Patent
Drews et al.

(10) Patent No.: US 10,550,644 B2
(45) Date of Patent: Feb. 4, 2020

(54) DRILL BIT HAVING SHAPED LEADING CUTTER AND IMPREGNATED BACKUP CUTTER

(71) Applicant: VAREL INTERNATIONAL IND., L.L.C., Carrollton, TX (US)

(72) Inventors: Steven Wayne Drews, Cypress, TX (US); Peter Clark Wilson, Conroe, TX (US)

(73) Assignee: VAREL INTERNATIONAL IND., LLC., Carrollton, TX (US)

( * ) Notice: Subject to any disclaimer, the term of this patent is extended or adjusted under 35 U.S.C. 154(b) by 0 days.

(21) Appl. No.: 16/055,657

(22) Filed: Aug. 6, 2018

(65) Prior Publication Data

US 2019/0063160 A1 Feb. 28, 2019

Related U.S. Application Data

(60) Provisional application No. 62/549,042, filed on Aug. 23, 2017.

(51) Int. Cl.

| | |
|---|---|
| ***E21B 10/43*** | (2006.01) |
| ***E21B 10/55*** | (2006.01) |
| ***E21B 10/62*** | (2006.01) |
| ***E21B 44/00*** | (2006.01) |
| ***E21B 10/567*** | (2006.01) |
| *E21B 10/42* | (2006.01) |
| *E21B 10/54* | (2006.01) |

(52) U.S. Cl.

CPC ..... *E21B 10/43* (2013.01); *E21B 10/55* (2013.01); *E21B 10/567* (2013.01); *E21B 10/5673* (2013.01); *E21B 2010/425* (2013.01); *E21B 2010/545* (2013.01)

(58) Field of Classification Search

None

See application file for complete search history.

(56) References Cited

U.S. PATENT DOCUMENTS

| | | | | |
|---|---|---|---|---|
| 4,991,670 | A | 2/1991 | Fuller | |
| 8,418,785 | B2 | 4/2013 | Azar | |
| 9,284,790 | B2 * | 3/2016 | Zhang | E21B 10/56 |
| 9,567,807 | B2 | 2/2017 | Green | |
| 10,066,444 | B2 * | 9/2018 | Evans | E21B 10/567 |
| 2007/0079995 | A1 * | 4/2007 | McClain | E21B 10/43 175/426 |
| 2015/0259988 | A1 * | 9/2015 | Chen | E21B 10/5673 175/430 |
| 2015/0345228 | A1 | 12/2015 | Williams | |
| 2017/0058615 | A1 | 3/2017 | Liang | |

* cited by examiner

*Primary Examiner* — Matthew R Buck
*Assistant Examiner* — Douglas S Wood

(57) ABSTRACT

A bit for drilling a wellbore includes: a shank having a coupling formed at an upper end thereof; a body mounted to a lower end of the shank; and a cutting face forming a lower end of the bit. The cutting face includes: a blade protruding from the body; a leading cutter including: a substrate mounted in a pocket formed in a leading edge of the blade; and a cutting table made from a superhard material, mounted to the substrate, and having a non-planar working face with a cutting feature; and a backup cutter mounted in a lower face of the blade at a position trailing the leading cutter and made from a composite material including a ceramic or cermet matrix impregnated with a superhard material.

13 Claims, 3 Drawing Sheets

DRILL BIT HAVING SHAPED LEADING CUTTER AND IMPREGNATED BACKUP CUTTER

BACKGROUND OF THE DISCLOSURE

Field of the Disclosure

The present disclosure generally relates to a drill bit having a shaped leading cutter and an impregnated backup cutter.

Description of the Related Art

U.S. Pat. No. 4,991,670 discloses a rotary drill bit for use in drilling holes in subsurface earth formations and including a bit body having a shank at one end for connection to a drill string and an operating end face at the other end. A plurality of first cutting structures, each comprising a preform cutting element, is mounted in the bit body at the end face thereof, and each has a superhard front cutting face. The bit body includes a plurality of protuberances projecting outwardly from the adjacent portions of the end face, the protuberances forming a plurality of second cutting structures disposed in generally trailing relation, respectively, to at least some of the first cutting structures. Each of the protuberances is impregnated with superhard particles through a significant depth measured from the outermost extremity of the protuberance. At least a major operative portion of each of the second cutting structures is circumferencially separated from the respective leading first cutting structure by an open space, and is likewise radially separated from the nearest adjacent second cutting structure or structures.

U.S. Pat. No. 8,418,785 discloses a drill bit for drilling a borehole in earthen formations, the bit including: a bit body having a bit axis and a bit face including a cone region, a shoulder region, and a gage region; a first primary blade extending radially along the bit face from the cone region to the gage region; a plurality of cutter elements mounted to the first primary blade, wherein a first of the plurality of cutter elements has a planar cutting face and a second of the plurality of cutter elements has a convex cutting face; and wherein each cutting face is forward-facing.

U.S. Pat. No. 9,567,807 discloses an earth-boring tool includes a bit body, a plurality of first cutting elements, and a plurality of second cutting elements. Each of the first cutting elements includes a discontinuous phase dispersed within a continuous matrix phase. The discontinuous phase includes a plurality of particles of superabrasive material. Each of the second cutting elements includes a polycrystalline diamond compact or tungsten carbide. A method of forming an earth-boring tool includes disposing a plurality of first cutting elements on a bit body and disposing a second plurality of second cutting elements on the bit body. Another method of forming an earth-boring tool includes forming a body having a plurality of first cutting elements and a plurality of cutting element pockets and securing each of a plurality of second cutting elements within each of the cutting element pockets.

US 2015/0345228 discloses a drill bit including at least one blade with a plurality of cutting elements in the form of polycrystalline diamond cutters disposed on a leading edge of the blade, at least one diamond impregnated cutting region, disposed behind the leading edge of the blade, and wherein at least one of the cutters disposed on the leading, edge is an off-tip cutting element, arranged so that it does not engage with the formation during drilling until bit wear has taken place.

US 2017/0058615 discloses a convex ridge type non-planar cutting tooth and a diamond drill bit, the convex ridge type non-planar cutting tooth including a cylindrical body, the surface of the end portion of the cylindrical body is provided with a main cutting convex ridge and two non-cutting convex ridges, the inner end of the main cutting convex ridge and the inner ends of the two non-cutting convex ridges converge at the surface of the end portion of the cylindrical body, the outer end of the main cutting convex ridge and the outer ends of the two non-cutting convex ridges extend to the outer edge of the surface of the end portion of the cylindrical body, the surfaces of the end portion of the cylindrical body on both sides of the main cutting convex ridge are cutting bevels. The convex ridge type non-planar cutting tooth and the diamond drill bit have great ability of impact resistance and balling resistance. According to the features of drilled formation, convex ridge type non-planar cutting teeth are arranged on the drill bit with different mode, which can improve the mechanical speed and footage of the drill bit.

SUMMARY OF THE DISCLOSURE

The present disclosure generally relates to a drill bit having a shaped leading cutter and an impregnated backup cutter. In one embodiment, a bit for drilling a wellbore includes: a shank having a coupling formed at an upper end thereof; a body mounted to a lower end of the shank; and a cutting face forming a lower end of the bit. The cutting face includes: a blade protruding from the body; a leading cutter including: a substrate mounted in a pocket formed in a leading edge of the blade; and a cutting table made from a superhard material, mounted to the substrate, and having a non-planar working face with a cutting feature; and a backup cutter mounted in a lower face of the blade at a position trailing the leading cutter and made from a composite material including a ceramic or cermet matrix impregnated with a superhard material.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
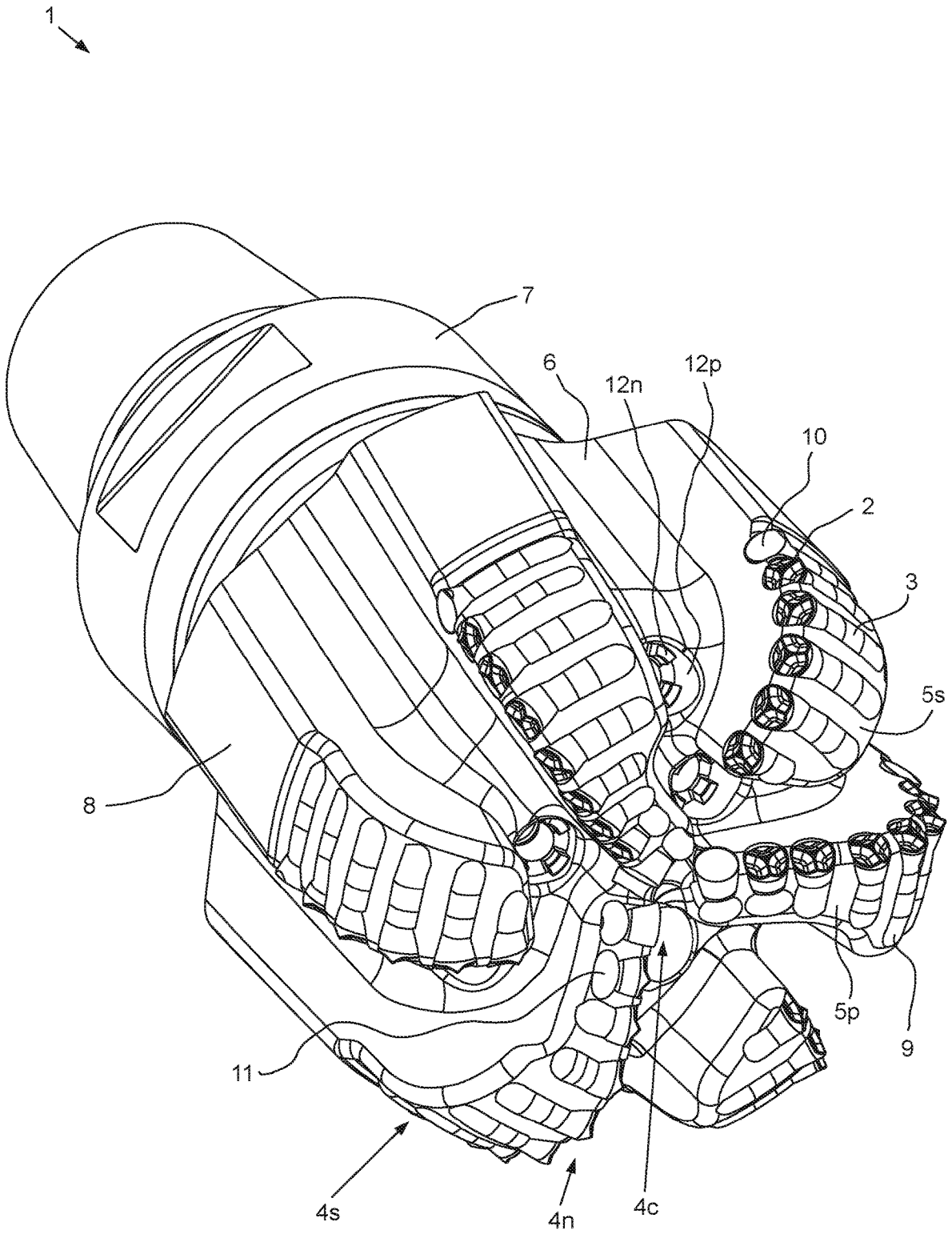
FIG. 1 illustrates a drill bit having a shaped leading cutter and an impregnated backup cutter, according to one embodiment of the present disclosure.
Figure 2A:
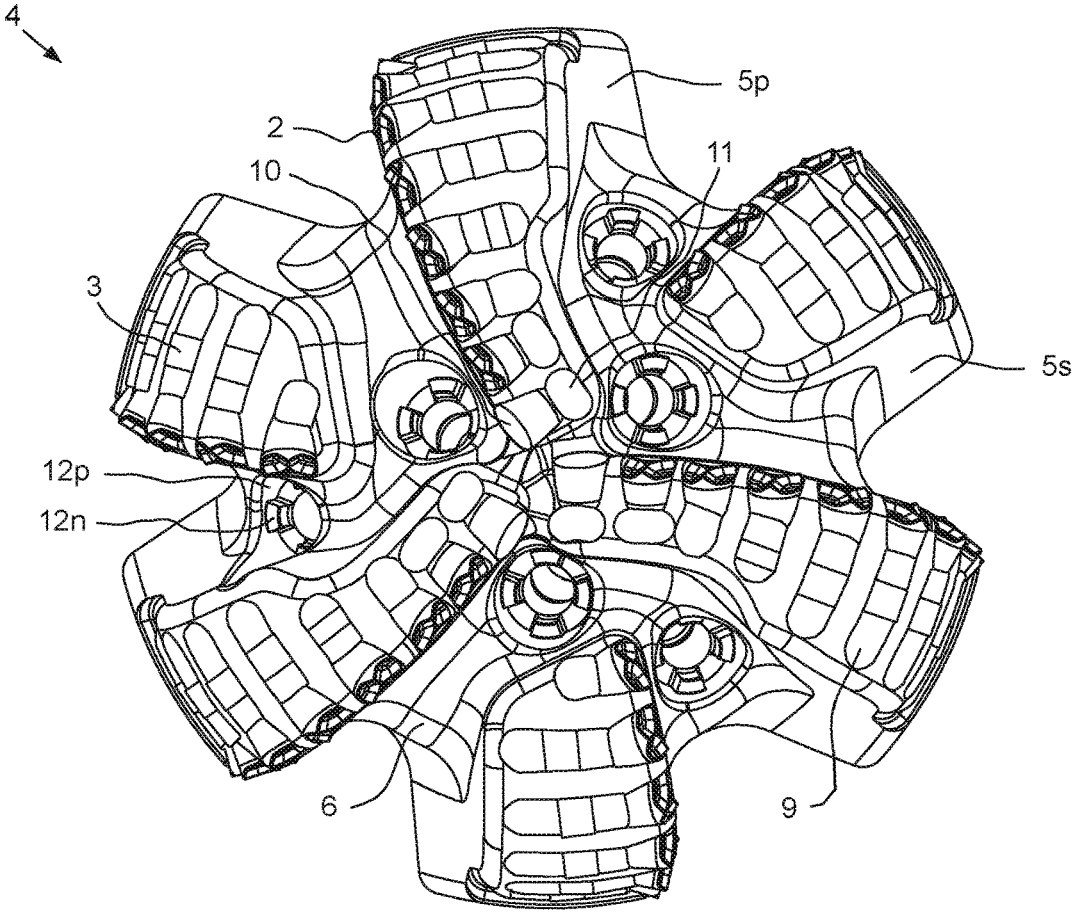
FIG. 2A illustrates a cutting face of the drill bit.
Figure 2B:
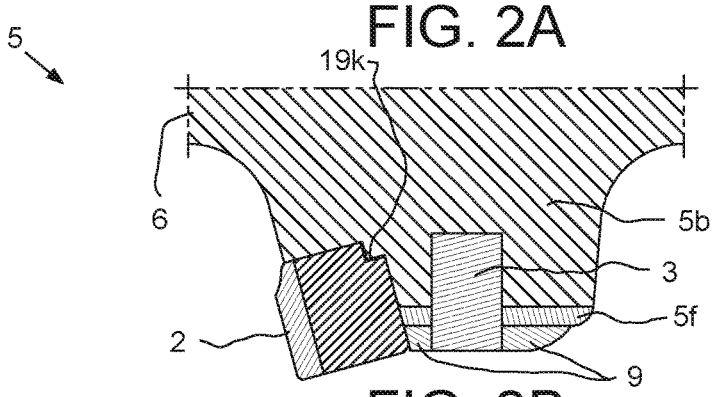
FIG. 2B illustrates a typical blade of the drill bit.

FIG. 1 illustrates a drill bit 1 having a shaped leading cutter 2 and an impregnated backup cutter 3, according to one embodiment of the present disclosure. FIG. 2A illustrates a cutting face 4 of the drill bit 1. FIG. 2B illustrates a typical blade 5 of the drill bit 1.

The drill bit 1 may include the cutting face 4, a bit body 6, a shank 7, and a gage section 8. A lower portion of the bit body 6 may be made from a composite material, such as a ceramic and/or cermet matrix powder infiltrated by a metallic binder, and an upper portion of the bit body 6 may be made from a softer material than the composite material of the upper portion, such as a metal or alloy shoulder powder infiltrated by the metallic binder. The bit body 6 may be mounted to the shank 7 during molding thereof. The shank 7 may be tubular and made from a metal or alloy, such as steel, and have a coupling, such as a threaded pin, formed at an upper end thereof for connection of the drill bit 1 to a drill collar (not shown). The shank 7 may have a flow bore formed therethrough and the flow bore may extend into the bit body 6 to a plenum (not shown) thereof. The cutting face 4 may form a lower end of the drill bit 1 and the gage section 8 may form at an outer portion thereof.

The cutting face 4 may include one or more (three shown) primary blades 5*p*, one or more (three shown) secondary blades 5*s*, fluid courses formed between the blades, the shaped leading cutters 2, the impregnated backup cutters 3, knobs 9, leading shear cutters 10, and shock studs 11. The cutting face 4 may have one or more sections, such as an inner cone 4*c*, an outer shoulder 4*s*, and an intermediate nose 4*n* between the cone and the shoulder sections. The blades 5 may be disposed around the cutting face and each blade may be formed during molding of the bit body 6 and may protrude from a bottom of the bit body. The primary blades 5*p* and the secondary blades 5*s* may be arranged about the cutting face 4 in an alternating fashion. The primary blades 5*p* may each extend from a center of the cutting face 4, across the cone 4*c* and nose 4*n* sections, along the shoulder section 4*s*, and to the gage section 8. The secondary blades 5*s* may each extend from a periphery of the cone section 5*c*, across the nose section 5*n*, along the shoulder section 5*s*, and to the gage section 8. Each blade 5*p,s* may extend generally radially across the cone 5*c* (primary only) and nose 5*n* sections with a slight spiral curvature and along the shoulder section 5*s* generally longitudinally with a slight helical curvature.

A base 5*b* of each blade 5 may be made from the same material as the lower portion of the bit body 6. A lower face 5*f* of each blade 5 may be made from the lower bit body material impregnated with a superhard material, such as diamond, to enhance abrasion resistance. The leading cutters 2, 10 may be mounted along leading edges of the blades 5 after infiltration of the bit body 6. The leading cutters 2, 10 may be pre-formed, such as by high pressure and temperature sintering, and mounted, such as by brazing, in respective pockets formed in the blades 5 adjacent to the leading edges thereof. The leading shear cutters 10 may occupy the pockets of the primary blades 5*p* adjacent to the center of the cutting face 4. The leading shear cutters 10 may also occupy the pockets of the blades 5 adjacent to the gage section 8. The rest of the pockets may be occupied by the shaped leading cutters 2.

Each shear cutter 10 may include a superhard cutting table, such as polycrystalline diamond, attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table.

The shock studs 11 may protrude from the lower face 5*f* of each primary blade 5*p* in the cone section 4*c* and may be aligned with or slightly offset from a respective leading cutter 2, 10. Each knob 9 may protrude from the lower face 5*f* of the respective blade 5 in the nose 4*n* and shoulder 4*s* sections. Each knob 9 may be located in a trailing position to a respective leading cutter 2, 10 and may be aligned with or slightly offset from the respective leading cutter 2, 10. Each knob 9 (with the exception of the inner most knobs on the secondary blades 5*s*) may extend across the respective lower face 5*f* from a back face of the respective pocket to a trailing edge of the respective blade 5. The blades 5, knobs, 9, and shock studs 11 may be formed during infiltration of the bit body 6. The shock studs 11 may be made from the same impregnated material as the lower face 5*f*. The knobs 9 may be made from a similar impregnated material as the lower face 5*f* except for having an increased diamond content for increased abrasion resistance. Each knob 9 may have an inclined leading end due to a back rake angle of the respective leading cutter 2, 10 and a quarter-spherical trailing end.

Each backup cutter 3 may be pre-formed from a composite material including a ceramic and/or cermet matrix impregnated with superhard particles. The superhard particles 10 may be diamond, may be synthetic, and may be monocrystalline or polycrystalline. If polycrystalline, the superhard particles may be thermally stable. Each backup cutter may be formed by sequentially stacking layers of the ceramic and/or cermet and layers of the superhard particles. The stacked layers may then be fused into a disc by infiltration with a metallic binder or hot isostatic pressing (having the binder present in the stacked layers).

Alternatively, each backup cutter 3 may be formed by additive manufacturing. The additive manufacturing process may include forming a base layer of a metallic cage, inserting the superhard particles into chambers of the base layer; forming an additional layer of the cage; inserting the superhard particles into chambers of the additional layer; and repetition until the cage is complete. Matrix material may then be poured into the cage and then the cage may be infiltrated by a metallic binder or hot isostatic pressed to fuse the components into a disc.

The backup cutters 3 may be inserted into a mold (not shown) used to infiltrate the bit body 6 and blades 5 such that the backup cutters are mounted to the blades by bonding during infiltration thereof. Each backup cutter 3 may protrude from the lower face 5*f* of the respective blade 5 in the nose 4*n* and shoulder 4*s* sections. Each backup cutter 3 may be located in a trailing position to a respective leading cutter 2, 10 and may be aligned with or slightly offset from the respective leading cutter 2, 10. Each backup cutter 3 may be disposed in a respective knob 9 and may divide the knob into a leading portion and a trailing portion. Each backup cutter 3 may be flush with the respective knob 9. Each backup cutter 3 may extend into the base portion 5*b* of the respective blade 5.

One or more (six shown) ports 12*p* may be formed in the bit body 6 and each port may extend from the plenum and through the bottom of the bit body to discharge drilling fluid (not shown) along the fluid courses. A nozzle 12*n* may be disposed in each port 12*p* and fastened to the bit body 6. Each nozzle 12*p* may be fastened to the bit body 6 by having a threaded coupling formed in an outer surface thereof and each port 12*p* may be a threaded socket for engagement with the respective threaded coupling. The ports 12*p* may include an inner set of one or more (three shown) ports disposed in the cone section 4*c* and an outer set of one or more (three shown) ports disposed in the nose section 4*n* and/or shoulder section 4*s*. Each inner port 12*p* may be disposed between an inner end of a respective secondary blade 5*s* and the center of the cutting face 4.

The gage section 8 may define a gage diameter of the drill bit 1. The gage section 8 may include a plurality of gage pads, such as one gage pad for each blade 5, and junk slots formed between the gage pads. The junk slots may be in fluid communication with the fluid courses formed between the blades 5. The gage pads may be disposed around the gage section 8 and each pad may be formed during molding of the bit body 6 and may protrude from the outer portion of the bit body. Each gage pad may be made from the same material as the bit body 6 and each gage pad may be formed integrally with a respective blade 5. Each gage pad may extend upward from a shoulder portion of the respective blade 5 to an exposed outer surface of the shank 7.

Figure 2C:
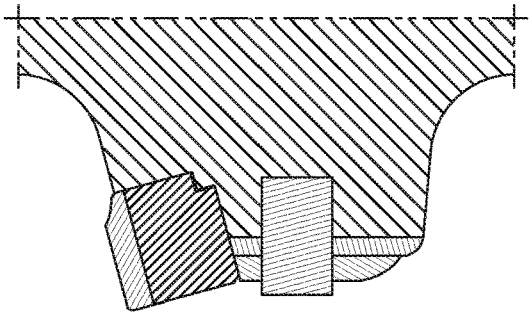
FIG. 2C illustrates an alternative blade having the backup cutter exposed, according to another embodiment of the present disclosure.

FIG. 2C illustrates an alternative blade having the backup cutter 3 exposed, according to another embodiment of the present disclosure. Alternatively, each backup cutter 3 may protrude more from the lower face 5*f* than the respective knob 9, thereby being exposed relative to the respective knob. Each leading cutter 2, 10 may be exposed relative to the respective knob 9 and an exposure of the backup cutter 3 may be less than the exposure thereof. Alternatively, the exposure of each backup cutter 3 may be equal to the exposure of the respective leading cutter 2, 10.

Figure 3A:
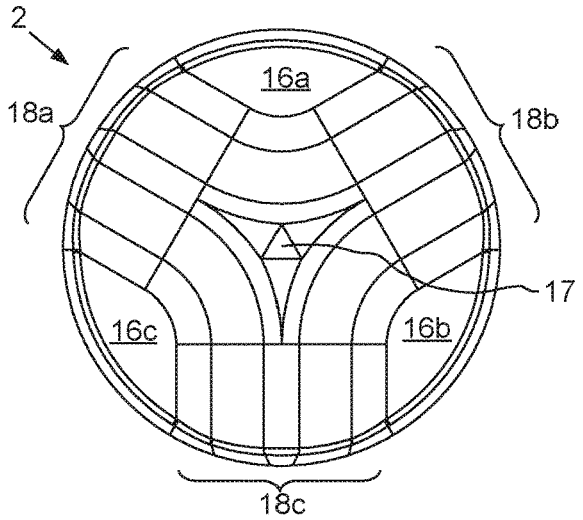
FIGS. 3A-3C illustrate a typical one of the shaped cutters.
Figure 3D:
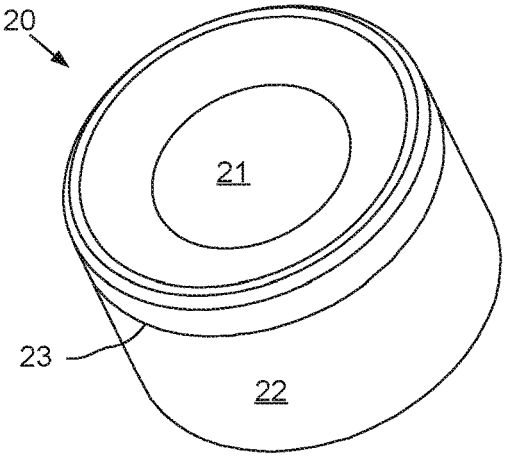
FIGS. 3D-3F illustrate alternative shaped cutters for use with the drill bit, according to other embodiments of the present disclosure.
Figure 3B:
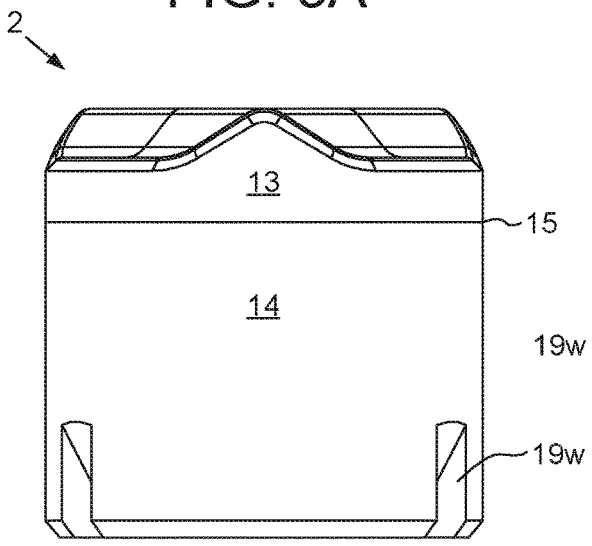
Figure 3E:
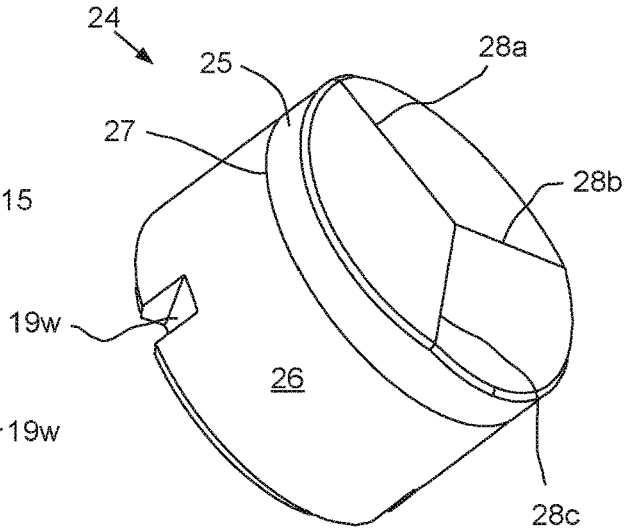
Figure 3C:
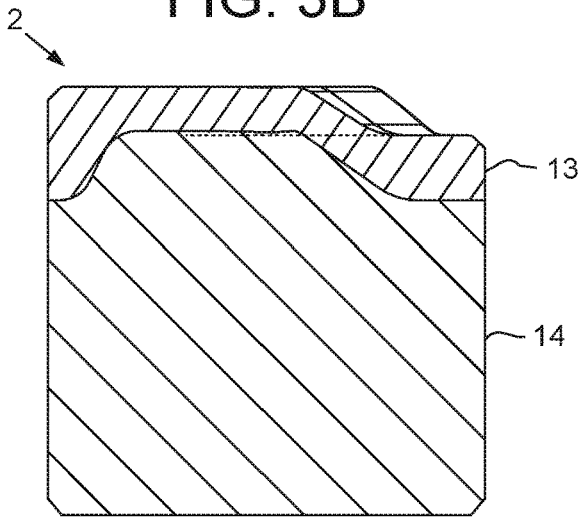

FIGS. 3A-3C illustrate a typical one of the shaped cutters 2. The shaped cutter 2 may include a non-planar cutting table 13 mounted to a cylindrical substrate 14. The cutting table 13 may be made from a superhard material, such as polycrystalline diamond, and the substrate 14 may be made from a hard material, such as a cermet, thereby forming a compact, such as a polycrystalline diamond compact. The cermet may be a cemented carbide, such as a group VIIIB metal-tungsten carbide. The group VIIIB metal may be cobalt.

The cutting table 13 may have an interface 15 with the substrate 14 at a lower end thereof and the working face at an upper end thereof. The working face may have a plurality of recessed bases 16*a-c*, a protruding center section 17, a plurality of protruding ribs 18*a-c*, and an outer edge. Each base 16*a-c* may be planar and perpendicular to a longitudinal axis of the shaped cutter 2. The bases 16*a-c* may be located between adjacent ribs 18*a-c* and may each extend inward from a side of the cutting table 13. The outer edge may extend around the working face and may have constant geometry. The outer edge may include a chamfer located adjacent to the side and a round located adjacent to the bases 16*a-c* and ribs 18*a-c*.

Each rib 18*a-c* may extend radially outward from the center section 17 to the side of the cutting table 13. Each rib 18*a-c* may be spaced circumferentially around the working face at regular intervals, such as at one-hundred twenty degree intervals. Each rib 18*a-c* may have a triangular profile formed by a pair of curved transition surfaces, a pair of linearly inclined side surfaces, and a round ridge. Each transition surface may extend from a respective base 16*a-c* to a respective side surface. Each ridge may connect opposing ends of the respective side surfaces. An elevation of each ridge may be constant (shown), declining toward the center section, or inclining toward the center section.

An elevation of each ridge may range between twenty percent and seventy-five percent of a thickness of the cutting table 13. A width of each rib 18*a-c* may range between twenty and sixty percent of a diameter of the cutting table 13. A radial length of each rib 18*a-c* from the side to the center section 17 may range between fifteen and forty-five percent of the diameter of the cutting table 13. An inclination of each side surface relative to the respective base 16*a-c* may range between fifteen and fifty degrees. A radius of curvature of each ridge may range between one-eighth and five millimeters or may range between one-quarter and one millimeter.

The center section 17 may have a plurality of curved transition surfaces, a plurality of linearly inclined side surfaces, and a plurality of round edges. Each set of the features may connect respective features of one rib 18*a-c* to respective features of an adjacent rib along an arcuate path. The elevation of the edges may be equal to the elevation of the ridges. The center section 17 may further have a plateau formed between the edges. The plateau may have a slight dip formed therein.

The substrate 14 may have the interface 15 at an upper end thereof and a lower end for being received in the respective leading cutter pocket. The substrate upper end may have a planar outer rim, an inner mound for each rib 18*a-c*, and a shoulder connecting the outer rim and each inner mound. A shape and location of the mounds may correspond to a shape and location of the ribs 18*a-c* and a shape and location of the outer rim may correspond to a shape and location of the bases 16*a-c* except that the mounds may not extend to a side of the substrate 14. Ridges of the mounds may be slightly above the bases 16*a-c* (see dashed line in FIG. 11C), level with or slightly below the bases. A height of the mounds may be greater than an elevation of the ribs 18*a-c*. The substrate 14 may have a keyway 19*w* formed therein for each ridge of the respective rib 18*a-c*. Each keyway 19*w* may be located at the edge of the substrate 45 and may extend from the pocket end thereof along a portion of a side thereof. Each keyway 19*w* may be angularly offset from the associated ridge, such as being located opposite therefrom.

Each pocket of the drill bit may have a key 19*k* formed therein for properly orienting the respective shaped cutter 2. During brazing of each shaped cutter 2 into the respective pocket, one of the keyways 19*w* may be aligned with the key 19*k* and engaged therewith to obtain the proper orientation. The proper orientation may be that the operative ridge is perpendicular to a projection (not shown) of the leading edge of the respective blade 5 through the pocket.

Alternatively, the key 19*k* and keyway 19*w* may be omitted and the substrate 14 may have one or more grooves formed in a side thereof, such as a groove for each ridge. Each groove may be aligned with the respective ridge and used for visual orientation by a technician during brazing of the shaped cutter 2 into the pocket.

In use (not shown), the drill bit 1 may be assembled with one or more drill collars, such as by threaded couplings, thereby forming a bottomhole assembly (BHA). The BHA may be connected to a bottom of a pipe string, such as drill pipe or coiled tubing, thereby forming a drill string. The BHA may further include a steering tool, such as a bent sub or rotary steering tool, for drilling a deviated portion of the wellbore. The pipe string may be used to deploy the BHA into the wellbore. The drill bit 1 may be rotated, such as by rotation of the drill string from a rig (not shown) and/or by a drilling motor (not shown) of the BHA, while drilling fluid, such as mud, may be pumped down the drill string. A portion of the weight of the drill string may be set on the drill bit 1. The drilling fluid may be discharged by the nozzles 12*n* and carry cuttings up an annulus formed between the drill string and the wellbore and/or between the drill string and a casing string and/or liner string.

FIG. 3D illustrates an alternative second shaped cutter 20 for use with the drill bit 1 instead of the shaped cutter 2. The second shaped cutter 20 may include a concave cutting table 21 attached to a cylindrical substrate 22. The cutting table 21 may be made from a superhard material, such as polycrystalline diamond, attached to a hard substrate, such as a cermet, thereby forming a compact, such as a polycrystalline diamond compact. The cermet may be a cemented carbide, such as a group VIIIB metal-tungsten carbide. The group VIIIB metal may be cobalt.

The cutting table 21 may have an interface 23 with the substrate 22 and a working face opposite to the interface. The working face may have an outer chamfered edge, a planar rim adjacent to the chamfered edge, a conical surface adjacent to the rim, and a central crater adjacent to the conical surface. The interface 23 may have a planar outer rim and an inner parabolic surface. The thickness of the cutting table 21 may be a minimum at the crater and increase outwardly therefrom until reaching a maximum at the rim. A depth of the concavity may range between four percent and eighteen percent of a diameter of the second shaped cutter 20. The substrate 22 may have a plurality of keyways (not shown) formed therein and spaced therearound. Each keyway may be located at the edge of the substrate 22 and may extend from the pocket end thereof along a portion of a side thereof.

Alternatively, sides of the cutting table 21 and substrate 22 may each be elliptical instead of circular. The keyways may then be used to orient the major axis of the cutter to the proper orientation.

FIG. 3E illustrates an alternative third shaped cutter 24 for use with the drill bit 1 instead of the shaped cutter 2. The third shaped cutter 24 may include a non-planar cutting table 25 mounted to a cylindrical substrate 26. The cutting table 25 may be made from a superhard material, such as polycrystalline diamond, and the substrate 26 may be made from a hard material, such as a cermet, thereby forming a compact, such as a polycrystalline diamond compact. The cermet may be a cemented carbide, such as a group VIIIB metal-tungsten carbide. The group VIIIB metal may be cobalt.

The cutting table 25 may have an interface 27 with the substrate 26 at a lower end thereof and a non-planar working face at an upper end thereof. The substrate 26 may have the interface 27 at an upper end thereof and a lower end for being received in the pocket. The pocket end of the substrate 26 may have an outer chamfered edge formed in a periphery thereof.

The working face may have a plurality of recessed bases, a plurality of protruding ribs, and an outer chamfered edge. The bases may be located between adjacent ribs and may each extend inward from a side of the cutting table 25. Each rib may extend radially outward from a center of the cutting table 25 to the side. Each rib may be spaced circumferentially around the working face at regular intervals, such as at one-hundred twenty degree intervals. Each rib may have a ridge 28*a-c* and a pair of bevels each extending from the ridge to an adjacent base.

The substrate 26 may have a keyway 19*w* formed therein for each ridge 28*a-c*. Each keyway 19*w* may be located at the edge of the substrate 26 and may extend from the pocket end thereof along a portion of a side thereof. Each keyway 19*w* may be angularly offset from the associated ridge 28*a-c*, such as being located opposite therefrom.

Figure 3F:
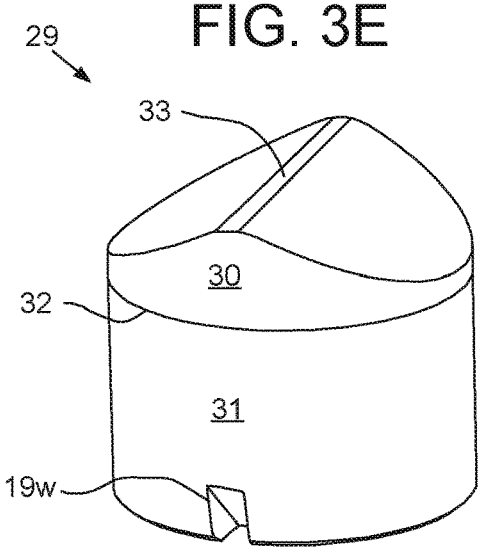

FIG. 3F illustrates an alternative fourth shaped cutter 29 for use with the drill bit 1 instead of the shaped cutter 2. The fourth shaped cutter 29 may include a non-planar cutting table 30 mounted to a cylindrical substrate 31. The cutting table 30 may be made from a superhard material, such as polycrystalline diamond, and the substrate 31 may be made from a hard material, such as a cermet, thereby forming a compact, such as a polycrystalline diamond compact. The cermet may be a cemented carbide, such as a group VIIIB metal-tungsten carbide. The group VIIIB metal may be cobalt.

The cutting table 30 may have an interface 32 with the substrate 31 at a lower end thereof and the working face at an upper end thereof. The working face may have an outer edge and a ridge 33 protruding a height above the substrate and at least one recessed region extending laterally away from the ridge. The ridge 33 may be centrally located in the working face and extend across the working face. The presence of the ridge 33 may result in the outer edge undulating with peaks and valleys. The portion of the ridge 33 adjacent to the outer edge may be an operative portion. Since the ridge 33 extends across the working surface, the ridge may have two operative portions. The working face may further include a pair of recessed regions continuously decreasing in height in a direction away from the ridge 33 to the outer edge that is the valley of the undulation thereof. The ridge 33 and recessed regions may impart a parabolic cylinder shape to the working face. The outer edge of the cutting table 30 may be chamfered (not shown).

The substrate 31 may include a keyway 19*w* for each operative portion of the ridge 33. Each keyway 19*w* may be located at the edge of the substrate 31 and may extend from the pocket end thereof along a portion of a side thereof. Each keyway 19*w* may be angularly offset from the associated operative portion, such as being located opposite therefrom.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:

a shank having a coupling formed at an upper end thereof;

a body mounted to a lower end of the shank; and a cutting face forming a lower end of the bit and comprising:

a blade protruding from the body;

a plurality of leading cutters, each leading cutter comprising:

a substrate mounted in a pocket formed in a leading edge of the blade; and a cutting table made from a superhard material, mounted to the substrate, and having a non-planar working face; and a plurality of backup cutters, each backup cutter mounted in a lower face of the blade at a position trailing the respective leading cutter and made from a composite material comprising a ceramic or cermet matrix impregnated with a superhard material, wherein:

each backup cutter is fixedly mounted to the blade by bonding, each working face has a protruding ridge extending from a side of the cutting table toward a center of the working face;

the blade has a plurality of knobs, each knob protruding from a lower face thereof at a position trailing the respective leading cutter, each backup cutter is disposed in the respective knob, and each knob extends across the lower face from a back face of the respective pocket to a trailing edge of the blade.

2. The bit of claim 1, wherein each backup cutter is flush with the respective knob.

3. The bit of claim 1, wherein each backup cutter is exposed relative to the respective knob.

4. The bit of claim 3, wherein each backup cutter is less exposed relative to the respective leading cutter.

5. The bit of claim 1, wherein the lower face and each knob are each made from a composite material comprising a ceramic or cermet matrix impregnated with a superhard material.

6. The bit of claim 1, wherein each backup cutter is a disc.

7. The bit of claim 1, wherein each leading cutter is mounted to the respective pocket by brazing material.

8. The bit of claim 1, wherein:

the cutting face has an inner cone section, an outer shoulder section, and an intermediate nose section, and the plurality of the leading cutters and the plurality of the backup cutters extend along the blade in the nose and shoulder sections.

9. The bit of claim 1, wherein each working face has the protruding ridge.

10. The bit of claim 1, wherein each working face has a plurality of protruding ridges spaced therearound.

11. The bit of claim 1, wherein:

a keyway is formed in each substrate, a key is formed in each pocket and engaged with the respective keyway, and each keyway is located at an edge of the respective substrate.

12. The bit of claim 11, wherein each keyway is located angularly opposite from the respective ridge.

13. The bit of claim 1, wherein each cutting table is made from a polycrystalline superhard material.

* * * * *